United States Patent [19]

Moertel

[11] 4,349,943

[45] Sep. 21, 1982

[54] SLIDE FASTENER STRINGER ELEMENTS WITH TONGUES AND GROOVED HEADS

[75] Inventor: George B. Moertel, Conneautville, Pa.

[73] Assignee: Talon, Inc., Meadville, Pa.

[21] Appl. No.: 154,649

[22] Filed: May 30, 1980

[51] Int. Cl.[3] ..... A44F 19/04

[52] U.S. Cl. ..... 24/205.13 R; 24/205.16 R

[58] Field of Search ..... 24/205.16 R, 205.13 R, 24/205.13 D

[56] References Cited

U.S. PATENT DOCUMENTS

| | | | |
|---|---|---|---|
| 2,347,428 | 4/1944 | Morin | 24/205.13 R |
| 2,495,033 | 1/1950 | Sullivan | 24/205.13 R |
| 2,637,886 | 5/1953 | Hora | 24/205.13 R |
| 2,959,833 | 11/1960 | Ryser | 24/205.13 R X |
| 3,886,634 | 6/1975 | Murata | 24/205.13 R |
| 4,040,150 | 8/1977 | Fukuroi | 24/205.13 R |
| 4,067,089 | 1/1978 | Forno | 24/205.13 R |

*Primary Examiner*—Roy D. Frazier
*Assistant Examiner*—Peter A. Aschenbrenner
*Attorney, Agent, or Firm*—O'Brien & Marks

[57] ABSTRACT

A coupling element for a slide fastener has a grooved head adapted to receive tongues of opposed elements to prevent lateral shifting of the elements. The tongues, as well as tapes embedded in the elements, are upwardly offset from the center of the elements so that the top edges of the tapes, the tongues and the grooves are coplanar. Flat abutment surfaces at the rear of the head absorb transverse loads and stabilize the fastener.

7 Claims, 7 Drawing Figures

SLIDE FASTENER STRINGER ELEMENTS WITH TONGUES AND GROOVED HEADS

TECHNICAL FIELD

This invention relates to slide fasteners, commonly called zippers. In particular, the invention pertains to coupling elements of the symmetrical type and a stringer having such elements.

DESCRIPTION OF THE PRIOR ART

Prior art symmetrical slide fasteners are exemplified by U.S. Pat. Nos. 3,330,013, 3,874,038, 3,886,634 and 3,964,137. In fasteners of this type, each coupling element is symmetrical about a transverse center plane; consequently opposite halves of the fastener, called the stringers, are identical. Advantageously, symmetrical stringers can be reversed end for end, which simplifies fastener assembly; futhermore, the fastener can be opened or closed in either direction. A disadvantage of such fasteners is that the complex configuration of typical symmetrical elements renders them relatively difficult to mold.

The aforementioned U.S. Pat. No. 3,886,634 discloses elements of the symmetrical type particularly employing wings or tongues on necks together with grooves in heads of the elements for engaging grooves and for receiving wings or tongues of similar opposing elements. The grooves must be sufficiently wider than the tongues to permit easy insertion of the tongues in the grooves. Due to the relative widths of the grooves and tongues as well as tolerance requirements, opposing elements can have considerable relative movement in directions perpendicular to the plane of the slide fastener tapes. However excessive relative movement perpendicular to the plane of the fastener tapes can interfere with movement and operation of sliders on the fasteners.

SUMMARY OF THE INVENTION

The invention is summarized in a slide fastener stringer including a mounting tape; and a row of coupling elements attached to one edge of the tape; each element including a body molded around the one edge of the tape, a narrowed neck portion extending from the body away from the tape, a heat attached to the neck, a pair of tongues extending outwardly from the neck, the head having a longitudinal groove therein for receiving a tongue of each of a pair of adjacent elements in an opposing stringer, the tape, the tongues and the grooves having top surfaces all of which are coplanar.

An object of the invention is to construct a slide fastener element having a plurality of coplanar surfaces to facilitate molding of the elements in a separable mold.

Another object of the invention is to provide a coupling element configuration in which the mold parting line is substantially closer to the top of the element than to its bottom to facilitate manufacture by band molding.

A further object of the invention is to stabilize a symmetrical stringer having an offset tape against flexing.

One advantage of the invention is the prevention of excess relative movement perpendicular to the plane of the slide fastener between opposed coupling elements with interlocking neck tongues and head grooves.

Other objects, advantages and features of the invention will be apparent from the following description of the preferred embodiment taken in conjunction with the accompanying drawings.

DESCRIPTION OF THE PREFERRED EMBODIMENT

Figure 1:
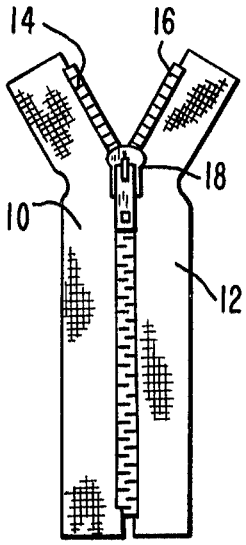
FIG. 1 is a top plan view of a slide fastener embodying the present invention.
Figure 3:
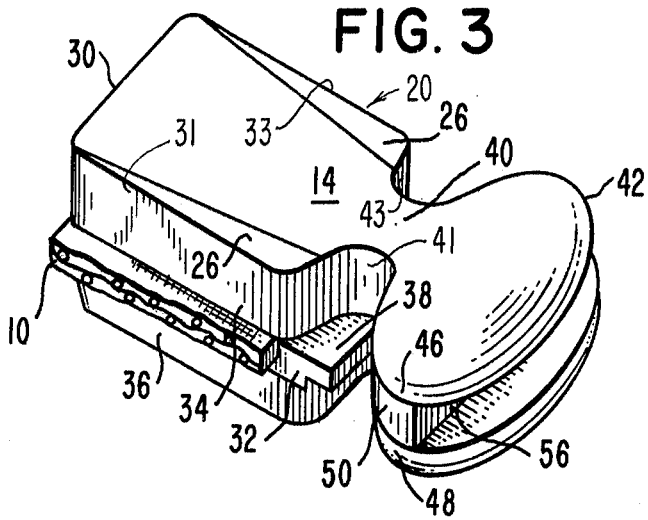
FIG. 3 is a perspective view, even more enlarged, of one coupling element and tape segment broken away from the fastener of FIGS. 1 and 2.
Figure 2:
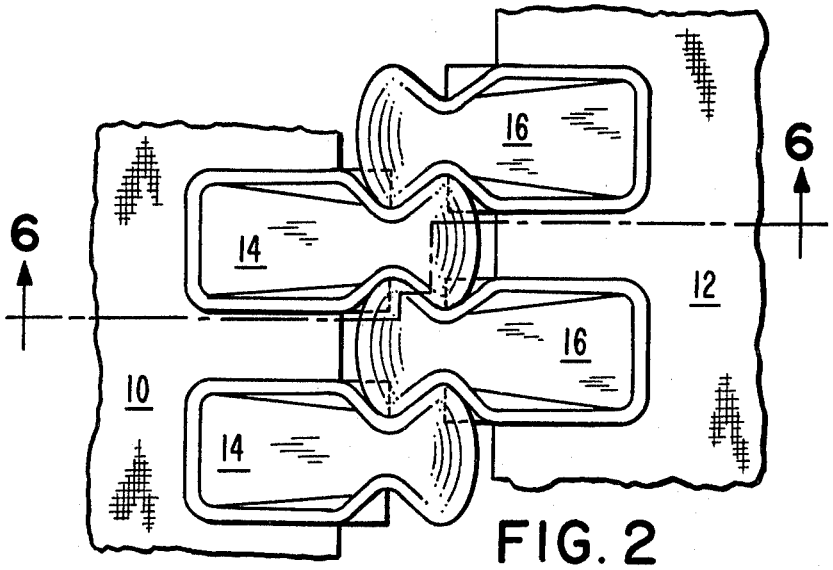
FIG. 2 is an enlarged plan view of a broken-away portion of the fastener of FIG. 1.
Figure 4:
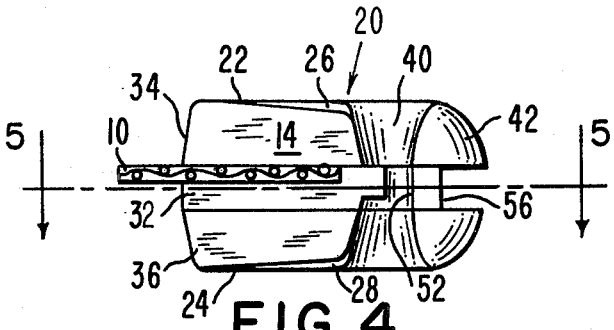
FIG. 4 is a front sectional view of the coupling element and tape segment of FIG. 3.
Figure 5:
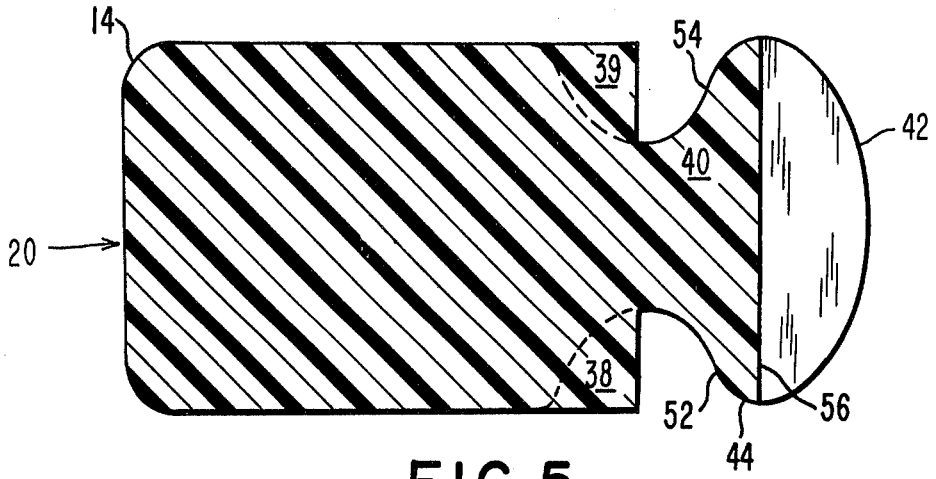
FIG. 5 is a sectional view taken along the line 5—5 in FIG. 4.

As illustrated in FIG. 1, a slide fastener embodying the invention includes a pair of coplanar support tapes 10 and 12 having rows of interlocking coupling elements 14 and 16 respectively attached to the inner edges thereof. The tape 10 and elements 14 form a left stringer, while the tape 12 and elements 16 form a right stringer. The stringers are interengaged and disengaged by movement therealong of a slider 18. As best seen in FIG. 2, the left and right stringers with the coupling elements 14 and 16 are substantially mirror images of each other.

As shown in FIGS. 2–5, each of the coupling elements 14 and 16, which preferably are formed from a thermoplastic material by molding directly around the inner edges of the tapes 10 and 12, includes a body portion indicated generally at 20, a narrowed neck portion 40 defined by recesses 41 and 43 on opposite sides of the element 14, and a head 20 supported by the neck 40.

The body 20 has an upper portion 34 and a lower portion 36 disposed and mounted on respective upper and lower sides of an inner edge portion of the tape 10. The upper portion 34 has a top surface including a flat surface 22 parallel to the tape and extending through the neck 40 to the head 20, and chamfered triangular surface portions 26 extending on opposite sides of the surface 22. A heel surface 30 and side surfaces 31 and 33 of the upper portion 34 are bevelled at a suitable small angle such as fifteen degrees to a normal to the tape 10 to allow the elements 14 to be easily stripped from mold cavities (not shown) during manufacture. The lower portion 36 is substantially larger than the upper portion 34 and is bounded in the upper region thereof by a surface 32 which extends around the sides and heel of the portion 36 as well as upward past the inner edge of the tape 10 to a mold parting line extending along the upper surface of the tape 10. The lower region of the lower portion 36 is substantially an inverted image of the upper portion 34 and includes a flat bottom surface 24, chamfered bottom surface portions 28, a bevelled heel surface, and bevelled side surfaces corresponding to the respective top surface 22, chamfered top surface portion 26, heel surface 30 and side surfaces 31 and 33 of the upper portion 34.

The central portion of the body 20 bounded by the surface 32 is geometrically centered in the body 20 between the top surface 22 and bottom surface 24. The tape 10 lies in the central portion substantially above the geometric center of the element 14, so that only the upper portion 34 of the element 14 extends above the tape 10.

A pair of tongues 38 and 39 extend from the body 20 into the respective recesses 41 and 43 parallel to the tape 10 for being engaged in grooves 56 (designated for the element 14) formed in the front rounded portions of the heads 42 of respective opposed elements which have locking projections received in the recesses 41 and 43. The tongues 38 and 39 are plate-like and are upwardly offset with respect to the geometric center of the elements, so that their top surfaces are coplanar with the top surface of the tape 10. Each tongue extends along the neck 40 approximately halfway from the body 20 toward the head 42. The groove 56 is geometrically centered between the top and bottom surfaces 22 and 24, the top of the groove being coplanar with the top of the tape 10. The thickness of the tongues 38 and 39 perpendicular to the tape 10 is substantially less than the width of the groove 56 perpendicular to the plane of the tape 10.

The head 42 and neck 40 have irregularly curved surfaces forming the recesses 41 and 43 and are shaped so as to interlock with complementary elements 16 in the opposite stringer when the fastener is closed. Each of these surfaces includes bevelled upper and lower portions 46 and 48 that make an angle of approximately 15 degrees with narrow unbevelled abutment surfaces 50 extending perpendicular to tape 10. The abutment surfaces 50 are centrally located between the top surface 22 and bottom surface 24 and have their upper edges in the mold parting line. The surfaces 50 extend to the extremities of the locking projections of the head 42.

The abutment surfaces 50 include a pair of planar portions 52 and 54, called flats hereafter, at the rear of the head 42 on the surfaces of the locking projections defining front sloped boundaries of the recesses 41 and 43. When viewed from above (FIG. 5), the flats 52 and 54 appear as straight line segments extending between arcs defining the neck 40 and extremities of the locking projections on the head 42. When the stringers are united as in FIG. 2, the flats 52 and 54 of the elements 14 bear against similar flats of opposing elements 16.

Figure 6:
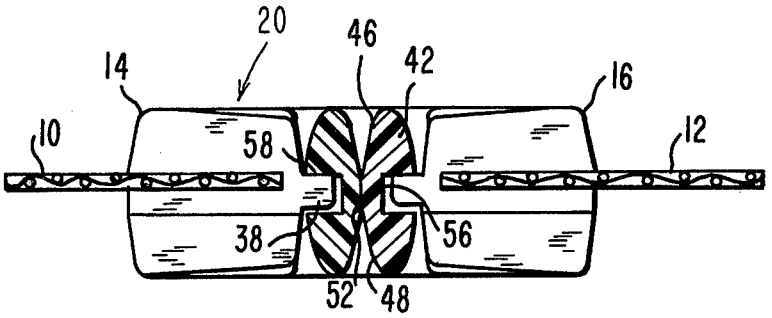
FIG. 6 is a sectional view taken along the line 6—6 in FIG. 2.
Figure 7:
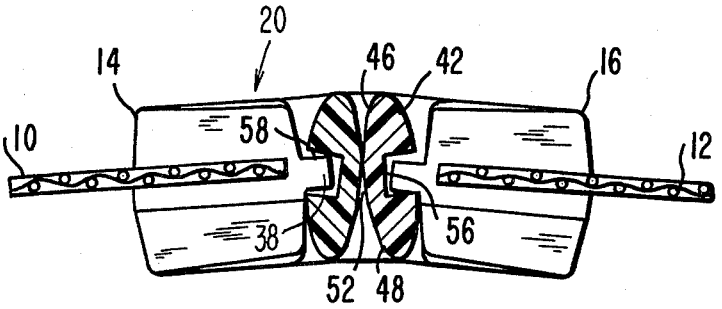
FIG. 7 is a view similar to FIG. 6, but with the coupling elements of the fastener shown in a flexed position.

In the operation of the slide fastener, movement of the slider 18 engages or disengages the locking projections of the heads 42 in the recesses 41 and 43 of the opposing coupling elements. The tongue 38 and 39 and grooves 56 prevent the stringers from disengaging by relative movement of elements 14 and 16 perpendicular to the thickness of the fastener. Since the top surfaces of the tongues 38 and 39 and the top of the grooves 56 lie in a common plane, upward or downward movement of either element 14 or 16 in FIG. 6 is prevented, despite the clearance provided beneath the tongues 38 and 39. This substantially eliminates excessive relative movement perpendicular to the plane of the tapes between opposing coupling elements to prevent interference with slider operation. Furthermore, upward flexure to a V-configuration is likewise impossible. Some downward flexure may occur, shown in FIG. 7, but that configuration is automatically resisted when tension is applied across the fastener.

Since the abutment surfaces 50 are perpendicular to the plane of the tapes 10 and 12, outward loads or crosswise forces applied to the tapes 10 and 12 produce forces between elements which are normal to the abutment surface 50. These crosswise forces on the tapes are off center with respect to the geometrical center of the elements and generate rotational forces on the elements which, in the absence of flats 52 and 54, would tend to bring about the flexed condition of FIG. 7 in the slide fastener. However, the extension of the width of the flats 52 and 54 to the upper surface of the tapes 10 and 12 resists the flexed configuration of FIG. 7, inasmuch as transverse tension on the fastener tends to bring the abutment surfaces 50 of adjacent elements flush together. Another benefit provided by the abutment surfaces 50 is that relatively large contact areas between elements are obtained.

The construction described above is particularly adapted for production by a band molding apparatus. The disposition of the top surfaces of the tape 10, the tongues 38 and 39 and the groove 56 minimize the intricacy of the mold design while allowing the use of desirably shallow cavities in the flexible band portion of the apparatus. One suitable band molding method and apparatus is described in my U.S. patent application No. 154,650 filed on even date herewith and entitled "CONTINUOUSLY MOLDING ARTICLES WITH INNER AND OUTER BANDS", now abandoned.

The upwardly offset printing line is particularly advantageous where a flexible band having cavities corresponding to the upper part of the elements is used to produce the fastener. By minimizing the band cavity depth, the band may be made relatively thin, whereby great band curvatures and hence a desirably small apparatus may be obtained.

Inasmuch as the invention is subject to many modifications, variations and changes in detail, it is intended that all matter contained in the foregoing description or shown in the drawings shall be interpreted as illustrative and not in a limiting sense.

What is claimed is:

1. A slide fastener stringer comprising a mounting tape, and a row of coupling elements attached to one edge of the tape; each element comprising a body molded around the one edge of the tape, a narrowed neck portion extending from the body away from the tape, a head attached to the neck, a pair of tongues extending outwardly from the neck, the head having a longitudinal groove therein for receiving a tongue of each of a pair of adjacent elements in an opposing stringer, and the groove and the tongues having widths perpendicular to a plane of the tape wherein the width of the groove is substantially greater than the width of the tongues, the tape, the tongues and the groove having top surfaces all of which are coplanar whereby a center plane of the tongues is upwardly offset relative to a center plane of the groove.

2. A stringer as recited in claim 1 wherein the tape and the tongues are upwardly offset with respect to the geometric center of the coupling elements.

3. A stringer as recited in claim 2 wherein each coupling element has a periphery defined by an upper bevelled surface, a lower bevelled surface, and a central abutment surface extending between said bevelled surfaces, said abutment surface being perpendicular to a plane defined by said tape and having an upper edge coplanar with the tape, the tongues and the groove.

4. A stringer as recited in claim 3 wherein each element is symmetrical about a center plane transverse to the stringer.

5. A stringer as recited in claim 4 further including a pair of flat segments in each of said abutment surfaces for bearing transverse loads between stringers.

6. A stringer as recited in claim 5 wherein the elements are molded from a thermoplastic resin.

7. A slide fastener chain comprising a pair of slide fastener stringers as defined in claim 1 wherein the coupling elements of each stringer are interlocked with the coupling elements of the other stringer.

* * * * *